US005207035A

United States Patent [19]

Fowler

[11] Patent Number: 5,207,035

[45] Date of Patent: May 4, 1993

[54] ABOVE-CEILING CONTAMINANT SHIELDING SYSTEM FOR SENSITIVE BUILDING AREAS

[76] Inventor: John L. Fowler, 5604 W. 79th St., Prairie Village, Kans.

[21] Appl. No.: 531,464

[22] Filed: May 31, 1990

[51] Int. Cl.[5] ..... E04B 9/00

[52] U.S. Cl. ..... 52/22; 52/14; 52/486; 52/584

[58] Field of Search ..... 52/22, 11, 12, 13, 14, 52/486, 688, 689, 5, 44, 284, 455-458, 578-584, 782, 823-826, 584

[56] References Cited

U.S. PATENT DOCUMENTS 3,859,770 1/1975 Chambers et al. ..... 52/484

4,817,343 4/1989 Rutledge ..... 52/22

*Primary Examiner*—Carl D. Friedman

*Assistant Examiner*—Robert Canfield

*Attorney, Agent, or Firm*—Hovey, Williams, Timmons & Collins

[57] ABSTRACT

A contaminant shield is located above the finished ceiling in a building or office space and below potential sources of intrusive liquid contaminants to prevent such contaminants from leaking through the ceiling and intruding into the user space therebelow where sensitive electronic equipment may be located. The flat, imperforate expanse of the shield may be sloped to a slight degree such that liquids falling onto the shield are immediately drained therefrom. The shield is formed by a multitude of generally flat panels joined along their opposite sides to elongated, generally horizontally extending supports having provisions for clamp-like, watertight connections with the panels. Joints formed by abutting panels are sealed in a watertight manner through the use of gaskets sandwiched between downturned marginal edges of the panels. The entire shield may be suspended from overhead structure such as the roof of the building or floor slab of the next higher floor by cables and may, in turn, provide a means from which the finished ceiling may be suspended.

14 Claims, 3 Drawing Sheets 6.
6.

ABOVE-CEILING CONTAMINANT SHIELDING SYSTEM FOR SENSITIVE BUILDING AREAS

TECHNICAL FIELD

This invention relates to a protective shield designed for installation above the finished ceiling in office buildings, hospitals, and other structures where highly sensitive and costly electronic equipment and occupants in the space below need protection from accidental exposure to liquid contaminants from unwanted sources such as, for example, malfunctions in overhead delivery conduits, broken drain pipes, defective fire suppression systems, liquid spill s and overflows on higher floors in the building, and rainwater intrusion through storm damage.

BACKGROUND

Electronic computers and data processing equipment have rapidly become vital and heavily relied upon tools for businesses, industries, medical institutions, and governmental agencies. New services and products have been created by improvements to these machines. Equipment that once required a dedicated building may now require only a desk top.

Heretofore, risk of loss from liquid contamination was usually limited to paper records, and the rare computer room. Little, if anything, was done to prevent losses. Today, the evolution of electronic computer and data processing equipment has increased the threat of loss from contaminants to enormous proportions. This development has placed sensitive electronic equipment in high risk locations.

The uninterrupted operation of electronic computer/data processing equipment is vital to the function of the user. Once committed to this new equipment, the previously used methods are usually abandoned. The major cost from the disruption of service is usually loss of business or vital services, not the loss of the electronic equipment.

Equipment containing micro-processors are becoming more sensitive to liquid and air-borne contaminants. This is due to their increasing complexity and decreasing size. They require assembly in "clean rooms" to be free of contaminants during manufacturing. If contaminated, this type of equipment and the data within is expensive, difficult, and sometimes impossible to replace or repair.

Contaminants are found in many forms. One of the most destructive, liquids, are present in large quantities. Liquid contamination sources may include leaking or burst pipes, over-flowing plumbing fixtures, weather-related failures of building elements, fire fighting, construction debris, and spills during maintenance.

In a hospital or medical center, for instance, it would be very difficult to locate equipment in areas that would minimize exposure to contamination. Large numbers of water and water lines exist throughout these environments. Additionally, new computer-drive diagnostic and procedural equipment is constantly being introduced. This spreads sensitive equipment throughout the medial environment. Placement of the equipment is determined by need and availability of space, not risk factor.

As buildings age, their mechanical systems deteriorate, increasing the risk of mechanical failure. Plumbing will have become internally restricted, and corroded over the years. Additions and changes will have increased the number of joints which may fail. Furthermore, utility lines and systems within the building such as electrical conduits and heating, venting, and air conditioning conduits, may inadvertently serve as pipes during an accident to convey contaminants far from their source of origin.

High rise buildings also have larger sized mechanical systems, carrying greater volumes of potential contaminants. And, the greater the number of floors above a particular area, the higher the risk that the lower area will be subjected to damaging liquid intrusion of some kind.

A tenant may not have control over the other individuals and areas in a building. Deliberate or accidental damage may be incurred by vandalism or carelessness. The amount of public access to a building may increase this risk. Hospitals and government offices have a large volume of individuals passing through them.

Prior shielding systems, to the extent they exist, have been incorporated directly into the ceiling and wall constructions of the building space involved. Thus, they do not lend themselves to installation in existing structures with established wall and ceiling constructions already in place. Moreover, in many instances, their emphasis is on providing a dust-free environment, or one which is protected from air-borne contaminants, without regard to the problem of liquid intrusions.

SUMMARY OF THE PRESENT INVENTION

Accordingly, one important object of the present invention is to provide a novel shield system especially suitable for guarding against intrusive entry of liquid contaminants which is separate from the finished ceiling in a building space and is designed to be installed above the ceiling whereby to provide better protection than heretofore available and to permit new and retrofit installation in existing spaces with established walls and ceiling constructions.

A further important object of the invention is to provide a shield system which is not limited to use in a wall-to-wall environment covering an entire ceiling, but instead can be readily utilized over an isolated, particularly sensitive area, for example, without extending to less critical areas of the same building space not requiring the presence of the shielding system.

A further important object of the present invention is to provide a modular-type shield system which can be readily assembled in a manner to custom-fit the dimensions of the space to be protected. It is also an important object to provide a system of the foregoing type which accomplishes its intended function without requiring a high profile so that the system can be used within buildings having limited space above existing ceiling structures and overhead utilities systems.

In carrying out the foregoing and other additional objectives, the present invention contemplates a shield which is installed immediately above a ceiling in a building space but below potentially troublesome source of errant liquids. Preferably, the shield is suspended by wires or the like from overhead structural means such as the slab of the next higher floor in the building, the shield in turn serving to provide a basis from which the ceiling itself can be suspended, at least in the area where the shield is utilized.

The preferred form of the invention utilizes generally flat sheet metal panels that are fastened together in an imperforate plane overlying the ceiling, there being appropriate gasket materials utilized at the joints of the panels to maintain the resulting structure watertight. Providing the assembly of interconnected panels with a slight incline enables any liquid which is accidentally released onto the shield to be drained therefrom by gravity. A peripherally disposed trough or the like may be used around the shield to receive the draining liquid and to direct the same to a remote discharge location. Special elongated support assemblies extending along opposite sides of each longitudinal series of the panels provide stiffening rigidity to the expanse of interconnected panels, facilitate modular-style installation and access to sources of contaminant intrusion, afford anchor means for suspending the shield from overhead slabs or other partitions, and provide a means from which the finished ceiling can be suspended. Cooperating upper and lower support channels of the support assemblies and a clamping plate therebetween are drawn together in a watertight manner against opposite, upper and lower faces of the panels at their marginal edges.

DETAILED DESCRIPTION

Figure 1:
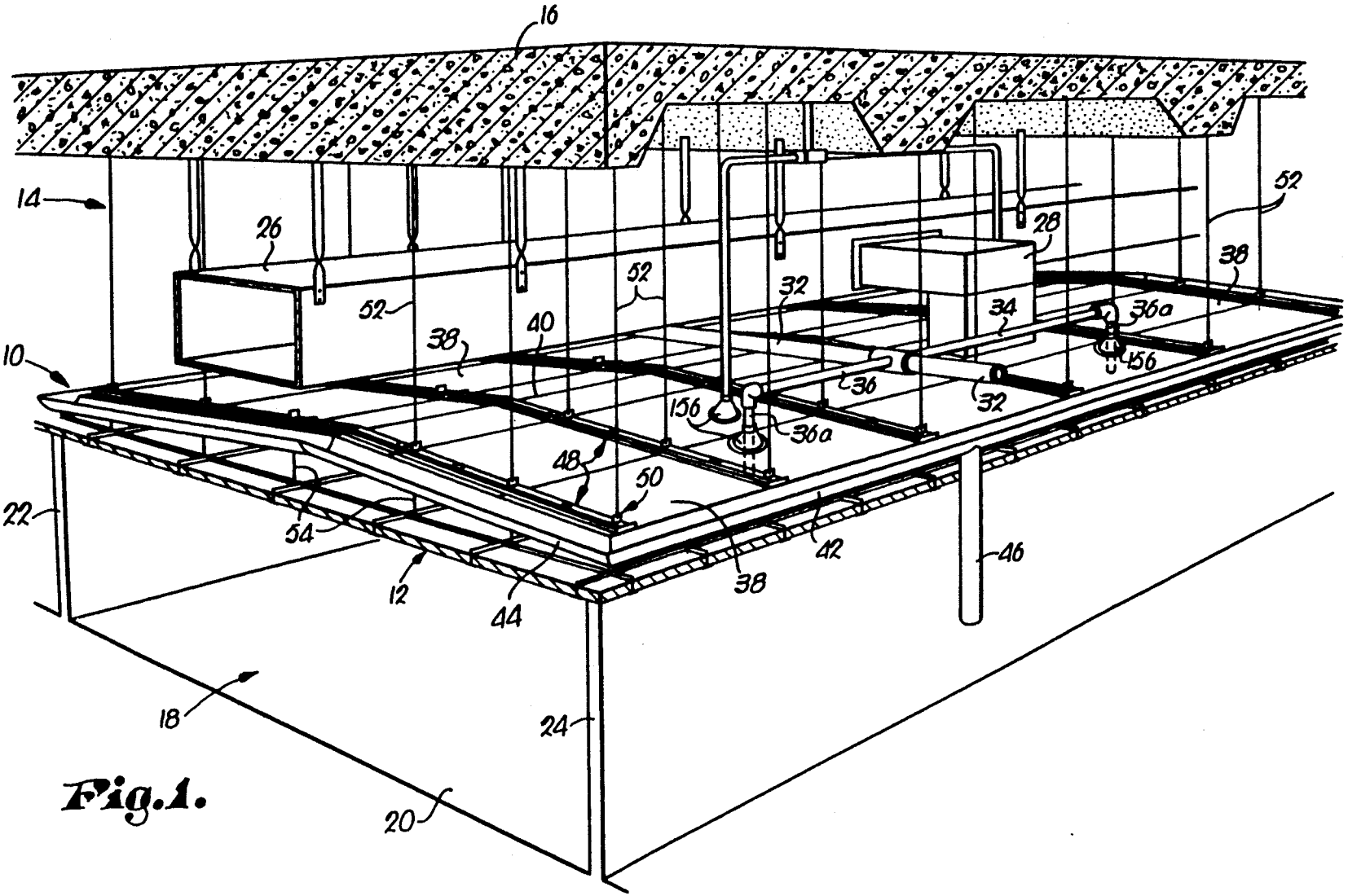
FIG. 1 is a fragmentary, top perspective view from the corner of a building space illustrating an installed contaminant shield in accordance with the principles of the present invention.

FIG. 1 shows the shield 10 of the present invention installed above a typical finished suspended ceiling 12 within a utilities region 14 that is defined beneath an upper boundary in the nature of a concrete slab 16 in a building space. For convenience, the area below the ceiling 12 may be defined as a use area 18, having a floor 20 and upright walls such as the illustrated walls 22 and 24.

The utilities apparatus within the region 14 may take a variety of forms. In FIG. 1, such apparatus has been illustrated as including various heating and air conditioning ducts 26 and 28, as well as fire suppression liquid supply conduits or lines 30, 32, 34, and 36. The shield 10 is located below such utility structures 26–36, except for down pipes such as the down pipe **36*a* that passes through the shield 10 and the ceiling 12 to deliver the fire suppression liquid to overhead sprinklers or the like within the use area 18. As will subsequently be explained in more detail, such down pipes 36*a* are sealed in a watertight manner at the points where they pass through the shield system 10**.

The shield 10 is of modular construction. Primarily, the shield 10 comprises a plurality of rigidly interconnected, generally flat panels 38, most of which are identical to one another but certain of which are slightly modified depending upon their positions within the shield.

The panels 38 are preferably constructed from sheet metal and are interconnected to form a flat, imperforate expanse that completely overlies that portion of the ceiling 12 and the underlying use area 18 in need of protection. In the embodiment illustrated in FIG. 1, the panels 38 are joined in an assembly that converges toward a ridge or peak 40 so that there are two sloping broad expanses leading downwardly and outwardly away from the peak 40 toward peripherally disposed troughs 42 (only one being shown) at the opposite lower extent of the sloping faces. End troughs 44 (only one being shown) may also be utilized, all of such troughs being for the purpose of receiving any liquid which may be accidentally discharged onto the shield 10 and draining the same away by gravity into one or more downspouts 46.

It is to be understood that while troughs 42 and 44 have been shown in the illustrated embodiment, the present invention is not limited to the use of such troughs in connection with the shield 10. Indeed, the shield 10 may be used without any troughs or downspouts at all since the primary object is to protect items directly underneath eh shield 10 and the matter of where else the deflected liquid contaminant drains is only of secondary importance.

As will be explained in more detail below, and as shown from its broadest perspectives in FIGS. 1 and 2, the panels 38 are secured at their opposite sides to parallel rows of elongated supports 48 aligned end-to-end which provide a means of interconnecting the panels transversely of the supports with one another and of stiffening the resulting assembly. They also serve as a convenient means by which the shield can be suspended from the overhead slab 16, and as a means by which the finished ceiling 12 can be suspended from the shield 10. In this regard, it will be noted that the supports 48 are provided at a number of locations with upstanding brackets 50 to which suspension cables 52 may be attached. At their upper ends, the cables 52 are secured by means not shown to the slab 16. Cables 54 from beneath supports 48 suspend the finished ceiling 12 from the shield 10. Obviously, numerous substitutions for the brackets 50 and the cables 52, 54 can be made by those skilled in the art without departing from the spirit of the invention including, for example, eye-bolts, eye-nuts, threaded rods, straps, sleeve nuts and other hardware.

Figure 4:
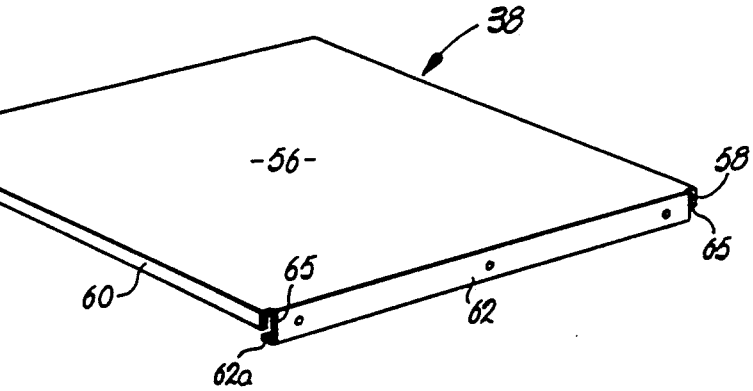
FIG. 4 is an enlarged, top front isometric view of one of the panels of the shield.

As particularly illustrated in FIG. 4, each of the panels 38 has a broad, flat top 56. A pair of downturned lips 58 and 60 are disposed at opposite side margins of the top 56 comprising edge portions that are connected with the supports 48 in a manner yet-to-be-described. The remaining two ends of each panel 38 are formed in the nature of downturned end faces 62 and 64 designed to abut corresponding end faces of other panels 38 within the shield. The end faces 62,64 are also provided with inturned stiffening legs **62*a* and 64*a***, respectively.

Each end face 62,64 is spaced slightly at its opposite ends from the proximal downturned lips 58,60 to define a small clearance gap 65.

Figure 2:
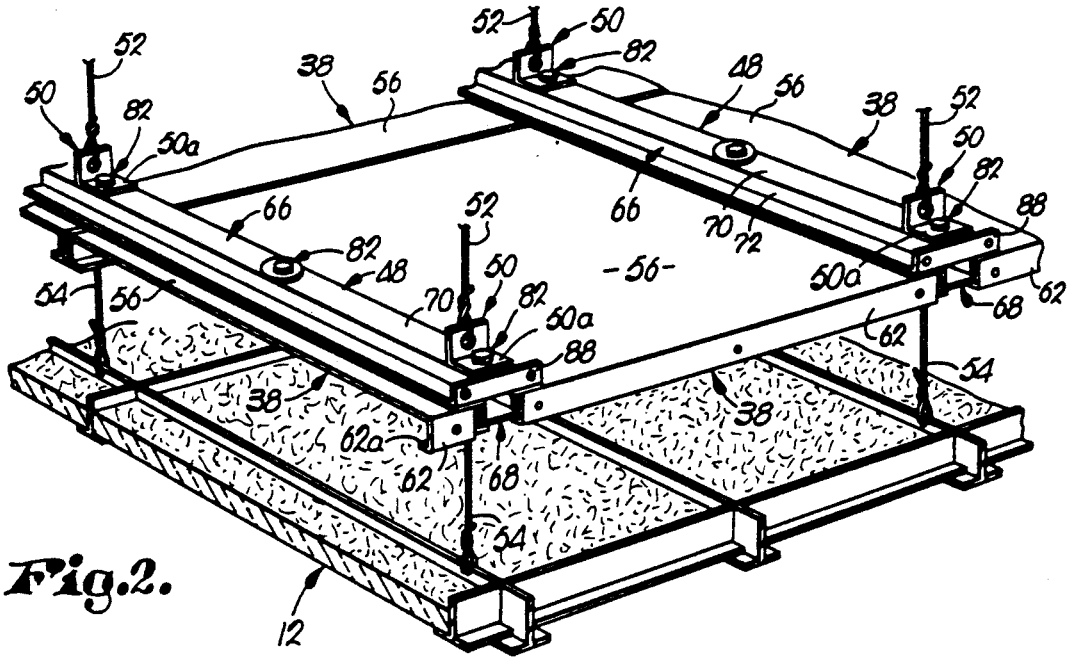
FIG. 2 is an enlarged, fragmentary, top front isometric view of a portion of the shield of FIG. 1 and the finished ceiling suspended therebelow.
Figure 3:
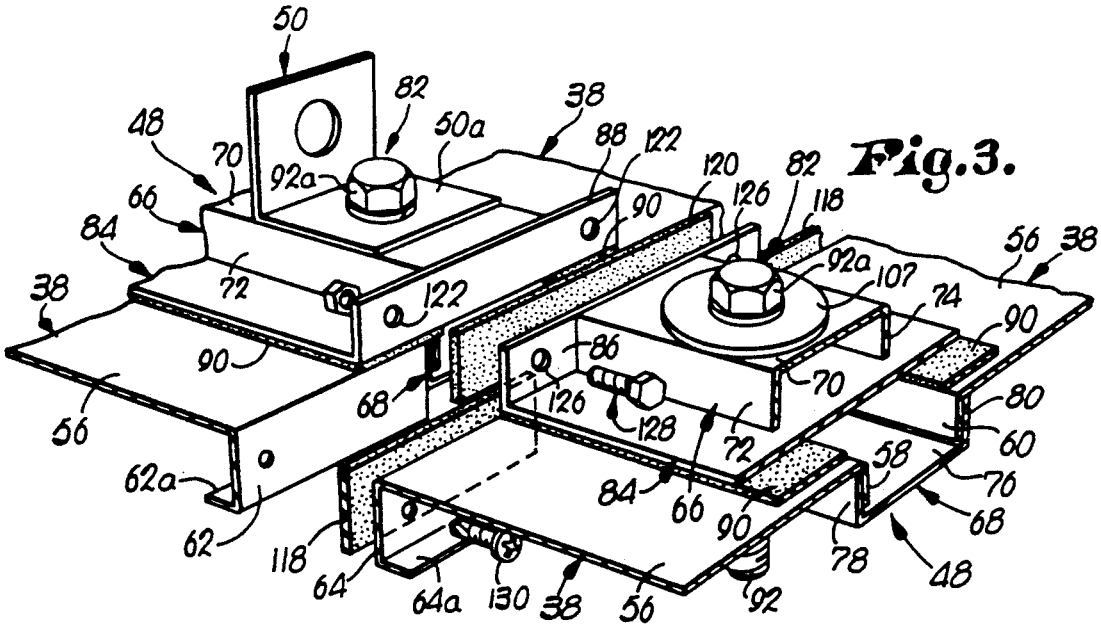
FIG. 3 is a further enlarged, fragmentary, top front exploded isometric view of the abutting ends of two support assemblies of the shield and adjacent panels.
Figure 6:
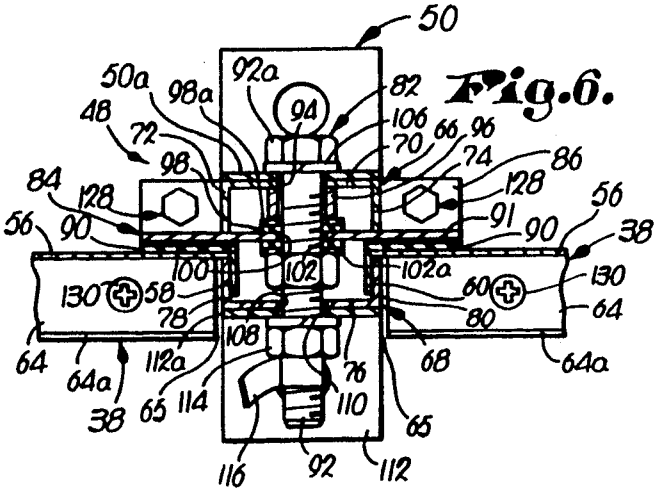
FIG. 6 is a fragmentary, transverse cross-sectional view through the shield taken substantially along line 6—6 of FIG. 5.

As illustrated best in FIGS. 2, 3, and 6, each of the supports 48 is elongated and has as its primary components a pair of transversely U-shaped, elongated, upper and lower channel members 66 and 68, respectively, and a flat 3 elongated plate member 84 clamped between channels 66, 68. As will be seen, the lower channel 68 and the plate 84 serve as the primary clamping components for joining panels 38 to the support 48, while the upper channel 66 serves as a structural stiffening means for plate 84. The upper channel 66 has an elongated, top wall 70 and a pair of elongated, laterally spaced depending legs 72 and 74 integral with top wall 70, while the bottom channel 68 has an elongated bottom wall 76 and a pair of elongated, laterally spaced, upwardly projecting legs 78,80 integral with bottom wall 76. The two channels 66, 68 are releasably held in position in mutually inverted relationship by bolt assemblies 82 located at periodic positions along the length of support 48 and serving to detachably clamp the various panels 38 in place within the supports 48, as will now be described.

As shown in FIGS. 3 and 6, for example, the presence of the gap 65 at each corner of the panels 38 provides the downturned lips 58 and 60 with a sufficient overhanging relationship to the end faces 62 to permit lips 58 and 60 to hook over the upstanding legs 78 and 80 of the lower channel member 68.

Each plate 84 is sufficiently wide as to project laterally outwardly beyond the upper channel 66 in opposite directions for relatively short distances. At its opposite ends the plate 84 is provided with integral upstanding flanges 86 and 88 corresponding in width to the horizontal portion of the plate 84 and in height to the top channel 66.

Underneath the plate 84 are disposed a pair of flat, resilient gasket strips 90 corresponding in length to plate 84 and directly overlying corresponding marginal edge portions of adjacent panels 38 attached to the support 48. Each of the gasket strips 90 may be provided with a tacky adhesive layer 91 along its top surface for adhering the gasket strip 90 to the underside of the plate 84. This provides a convenient means of preassembling the gasket strips 90 to the plate 84 whereby to facilitate later installation of the shield 10 within a building space. As one alternative, the gasket strips 90 may take the form of a self-adhering butyl rubber product commonly used by those skilled in the heating, venting, air conditioning and plumbing trades.

As illustrated best in FIGS. 3 and 6, each bolt assembly 82 which clamps the components of support 48 together includes a number of components in addition to the bolt 92 itself. In this respect, the shank of the bolt 92 passes through a hole 94 in the top wall 70 of upper channel 66, thence downwardly through a cylindrical compression sleeve 96 within the upper channel 66, then through an upper, waterproof washer 98, then through a hole 100 in plate 84, followed by passage through a lower, waterproof washer 102 on the bottom side of the plate 84. A lock nut 104 is treaded onto the bolt 92 tightly up against the lower washer 102 so the plate 84 is sandwiched tightly between the washers 98,102 and the upper channel 66 is drawn tightly down against the plate 84. This action also causes the washers 98,102 to compress tightly and sealingly against the threads of bolt 92.

Preferably, the two washers 98,102 are of such a design that they have rubber faces and metal backings **98*a*, 102*a*. In the case of the washer 98, the backing 98*a* bears against the compression sleeve 96 and the rubber face bears against the plate 84, while in the case of the washer 102, the metal backing 102*a* bears against the lock nut 104 and the rubber face bears up against the bottom of the plate 84**. Suitable waterproof washers of this type may comprise bonded zinc/neoprene washers such as those available from Midwest Precision Products of Denver, Colo.

Preferably, a lock washer 106 is located on the bolt 92 immediately below the head **92*a* thereof. Those bolt locations occurring at the ends of certain of the supports 48 are also used as means for attachment of the suspension brackets 50 to the shield, in which event a horizontal leg 50*a* of the bracket 50 is trapped beneath the lock washer 106 and the top wall 70 of the upper channel 66. Where no bracket 50 is utilized, a large washer 107 underlies the lock washer 106 and a bolt head 92*a* to spread the load from bolt head 92*a* throughout a relatively broad area of the top wall 70 of upper channel 66**.

The shank of the bolt 92 also passes downwardly through the interior of the lower channel 68 and outwardly through a hole 108 in the bottom wall 76 of channel 68. In the particular bolt assembly 82 illustrated in FIG. 6, the shank of the bolt then also passes through a hole 110 in the horizontal leg **112*a* of a an L-shaped ceiling bracket 112 used in connection with the suspension cables 54 to hang the finished ceiling 12 from the shield 10. A nut 114 is threaded onto the bottom of the shank of the bolt 92 and is tightened up against the bracket 112 to force the lower channel 68 up against the underside of the panels 38 adjacent their downturned lips 58 and 60. A tamper-detecting seal 116 in the nature of an adhesive ribbon or the like may be wrapped around the bolt 92 immediately below the nut 114 to provide a visual indication of tampering with the bolt assemblies 82**.

As illustrated particularly in FIGS. 2, 3, and 6, the supports 48 in each row thereof are butted end-to-end against one another and secured in that relationship, as are the panels 38 in each series that extends longitudinally of the supports 48. Preferably, each of the supports 48 may span two of the panels 38 so as to present a joint between supports 48 only at alternate joints between panels 38. It has been found convenient to have the panels 38 formed in approximate four-foot by four-foot squares and the supports 48 in eight-foot lengths.

A transversely extending gasket strip 118 is located between the end faces 62 and 64 of abutting panels 38 (FIGS. 3 and 5), such strip 118 being of similar construction to the gasket strips 90. A separate gasket strip 120 is located between the abutting flanges 86 and 88 associated with the end-to-end supports 48 and is coextensive in length with the flanges 86, 88. Preferably, the gasket strip 120 is also of the same construction as the gasket strips 90. To facilitate later installation, the gasket strip 120 may be pre-adhered to its end flange 86; similarly, the gasket strip 118 may be pre-adhered to its panel end face 62.

Figure 5:
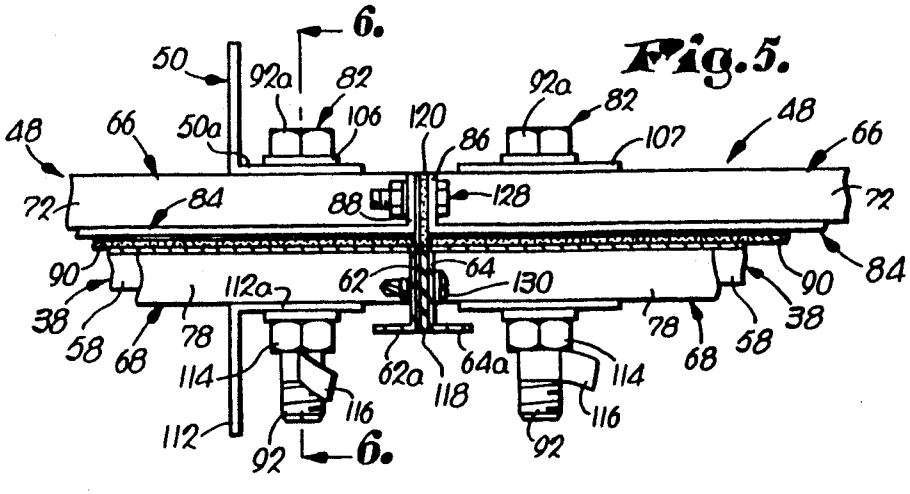
FIG. 5 is a fragmentary, longitudinal cross-sectional view through a pair of abutting panels of the shield and illustrating the joint between such panels and between the ends of the associated support assemblies.

As shown in FIG. 3, the end flange 88 of the plate 84 on one support 48 is provided with a pair of horizontally disposed, transversely spaced holes 122. Such holes 122 align with corresponding transversely spaced holes (not shown) in the gasket strip 120 and transversely spaced holes 126 in the end flange 86 associated with the abutting support 48. Such holes 122 and 126 receive horizontally disposed fastening bolt assemblies 128, while the end faces 62,64 of the abutting panels 38 are provided with sheet metal screws 130 passing through such faces and the intermediate gasket strip 118 as illustrated in FIGS. 3 and 5. In this manner, the shield 10 is provided with a water-tight, imperforate surface even at the joints between the supports 48 and the panels 38.

Figure 8:
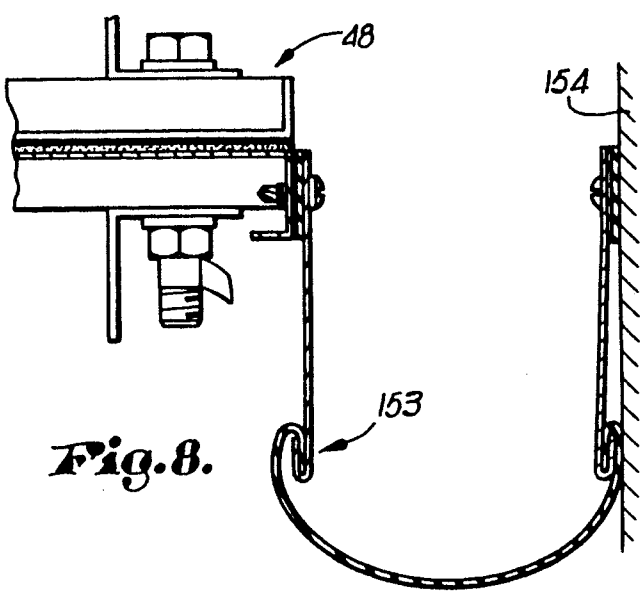
FIG. 8 is a fragmentary, longitudinal cross-sectional view of one end of a support of the shield illustrating the manner in which the end of the shield may be flexibly attached to a wall of the building.
Figure 7:
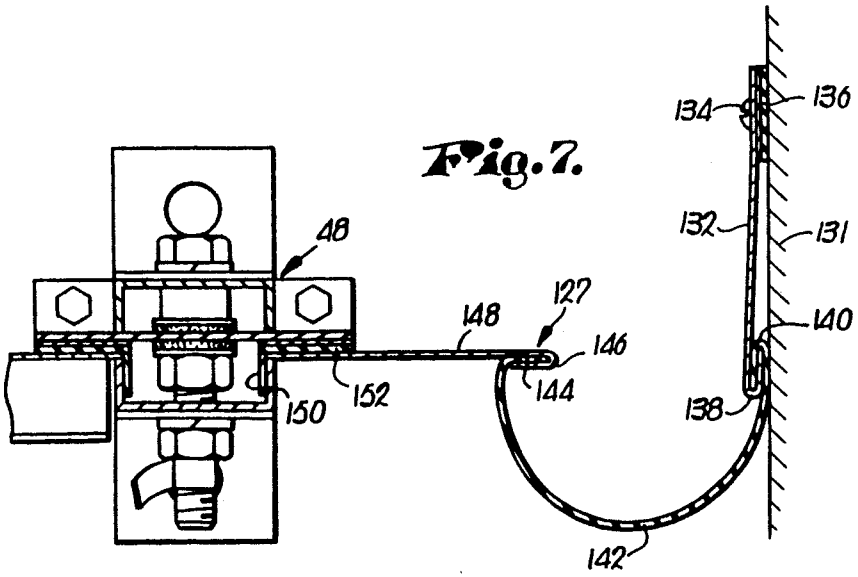
FIG. 7 is a fragmentary, transverse cross-sectional view through one of the supports of the shield illustrating the manner in which the shield may be flexibly coupled with a structural sidewall of the building space in which the shield is used.

FIGS. 7 and 8 illustrate the manner in which the shield 10 may be flexibly secured to adjoining upright wall structures within the utilities region 14 if such structures are present in the area where the shield is being used. Such flexibility is important because walls in buildings contain linear distortions, both vertical and horizontal, which makes connectors of fixed dimensions of little value. Moreover, buildings shift, expand and contract with seasonal changes and age. And in areas of frequent seismic activity or heavy vibration, shifting structures can increase the threat of contamination. The flexible connection absorbs structural variations and requires less fitting during installation. As will be seen, such methods of connection may also serve as troughs for gutters for channeling off the liquid which is drained from the sloped surface of the shield.

In this respect, it will be noted that FIG. 7 shows how the lateral sides of the shield may be connected through a flexible connection 127 to an adjacent upright wall 131. An elongated sheet metal strip 132 extends alongside of the outboardmost support 48 of the shield and corresponds in length to the length dimension of the shield. A number of screw-type fasteners 134 along the length of the strip 132 secure the same to the wall 131, with the strip 132 spaced slightly outwardly from the wall 131 by a sealing gasket strip 136. The lower edge 138 of the strip 132 is crimped around the inturned marginal extremity 140 of a flexible fabric web 142 of neoprene or the like which may or may not be utilized as a trough corresponding to the troughs 42 and 44 illustrated in FIG. 1. The opposite marginal extremity 144 of web 142 is retained by the crimped edge 146 of another sheet metal strip 148 having a downturned portion 150 hooked over the upturned leg 78 or 80 of the adjacent lower channel 68. A gasket strip 152 is clamped between the overhead metal plate 84 and the underlying sheet metal strip 148 in the same manner as the gasket strips 90 on the inboard supports 48. A suitable product for use as the flexible connection 127 is available from Ventfabrics of Chicago, Ill. under the mark VENTGLAS.

FIG. 8 shows the nature of the flexible connection 153 between the shield and an upstanding wall 154 at the longitudinal end of one of the supports 48. The connection 153 is similar to that which is used along the sides of the shield, as in FIG. 7, but with slight modifications in the method of attachment to the shield as is apparent from FIG. 8. As with the connection 127, a suitable product which may be used as the connection 153 is available from Ventfabrics of Chicago, Ill., under the mark VENTGLAS.

As illustrated in FIG. 1, the shield 10 may be provided with the peak 40 so that sloping faces for liquid discharge can be available on the shield 10 while using a minimum amount of vertical space. In some instances, such space between the utilities and the finished ceiling may be at a premium, particularly where there is a long expanse to be protected and it may be difficult to obtain an adequate pitch to the shield if only a single sloping surface is utilized. The peak 40 may be readily formed by simply bending the involved supports 48 and panels 38 in the appropriate direction.

OPERATION

Installation and use of the shield 10 should be apparent from the foregoing detailed description. In general, it will be appreciated that the shield 10 is disposed between the finished ceiling 12 and the overhead utilities so that in the event of liquid intrusion into the space above the ceiling 12, the liquid lands on the shield 10 instead of the ceiling 12. Obviously, the intruding liquid may come from a wide variety of potential sources including, for example, a malfunction or breakage in one of the lines 30–36 carrying fire suppression liquid, spills or overflows from directly overhead fixtures on higher floors, or inadvertent piping of unwanted liquids from remote sources of the liquids via heating, venting, and air conditioning ducts or electrical conduits. As mentioned above, the shield 10 is preferably inclined in at least one direction to cause the intrusive liquid to drain quickly away from the protected area beneath the shield 10. In a preferred embodiment, the liquid may be discharged into the trough 42 for delivery to the downspout 46.

It will be appreciated that regardless of where the intrusive liquid encounters the shield 10, all portions of the shield 10 are impervious to leakage by virtue of the tightly and securely sealed joints where various components of the shield connect together. Note in this respect that the supports 48 not only carry the load of the panels 38, but also provide a tight sealing action between the channel members 66 and 68, in cooperation with the gaskets 90 and the plate 84, to prevent leakage at that location. At the abutting ends of the supports 48, the end flanges 86 and 88 tightly sandwich the gasket 120 therebetween through the provision of bolts 128. Between the abutting ends of the panels 38, the downturned end faces 62,64 tightly sandwich the gasket strip 118 therebetween through the provision of the sheet metal screws 130. Note that because the gasket strips 118 do not project above the top walls 56 of the panels 38, there is no damming effect which would otherwise impede the rapid discharge of water along the rows of interconnected panels 38. At those few locations where upright portions of the water conduits extend through the panels 38, waterproof boots 156 are provided (FIG. 1) to seal the intersections, such boots being commonly used and understood by those skilled in the plumbing, electrical, and heating and air conditioning trades.

The thin panels 38 are preferably constructed of sheet metal to facilitate manufacture and reduce costs. The channels 66 and 68 of each support 48 may be produced in plastic or metal, although in the preferred embodiment, metal is utilized. Such channels may be extruded, if desired. One exemplary and commercially available channel is offered by Grinnell Corporation of Exeter, N.H., sold under the mark POWER-STRUT. Cross-sectional profiles other than that illustrated in the preferred embodiment may be satisfactory, provided they produce the necessary clamping, stiffening and supporting actions involved in the present invention. One alternative embodiment may combine the plate 84 and the upper channel 66 into a single extruded member.

When installing the shield 10, it is a relatively simple matter to assemble the various hardware components thereof without resorting to special or unusual tools. Conveniently, the top portion of each support 48, comprising the upper channel 66, the plate 84 with preattached gasket strips 90, bolt 92, sleeve 96, washers 98,102, and nut 108 can be preassembled. Certain of such assemblies can also be provided with the hanger brackets 50. Thereupon, such assemblies can be hung in place using the suspension cables 52 anchored to the upper slab 16 by suitable means, with the appropriate number of supports 48 aligned end-to-end in laterally spaced rows, and then bolted together. The bottom portions of the supports 48 and the panels 38 associated therewith may then be brought up into position, the lower channels 68 at first merely being slipped onto the extended lower ends of the bolts 92 and supported loosely in such positions by the retaining nuts 114. This leaves sufficient space between the plate 84 of each support and the upstanding legs 78,80 of the lower channel 68 to allow the downturned lips 58,60 of channels 38 on opposite sides of the support 48 to be hooked over the legs 78,80.

As the nuts 114 of the bolts 92 are then tightened, the channel 68 is drawn upwardly, carrying with it the adjacent panels 38 until such time as the gasket strips 90 become tightly compressed up under the plate 84, whereupon tightening of the nuts 114 can be discontinued. Depending upon the particular bolt 92 being manipulated, the assembly may or may not include one of the ceiling hangar brackets 112, all as illustrated in FIG. 6.

The panels 38 in the series between supports 48 may then be secured together using the sheet metal screws 130. As the screws 130 are tightened, the pre-applied gasket strips 118 between end faces 62, 64 of abutting panels 38 are squeezed tightly into a compressed state to provide a water-tight seal at that location.

It will be appreciated that the modular nature of the shield 10 provides great flexibility in establishing the size of the shield 10. Depending upon the situation at hand, the shield 10 may extend totally between main walls of the building space or only cover a certain isolated area spaced inwardly from such main structural walls. The user simply needs to add the appropriate number of supports 48 and panels 38 to the system as required to match the needs at hand. In the event certain of the panels 38 and supports 48 need to be modified in size and shape to accommodate space limitations or to fit around obstructions, such can be readily accomplished by merely cutting those components with conventional tools to the appropriate dimensions.

As earlier mentioned, the preferred embodiment of the invention contemplates producing each panel 38 from sheet metal. However, suitable plastic and fiberglass materials can also be used, both rigid and flexible. In the event flexible materials are utilized, in the nature of a web of such material, it may be necessary to weld adjacent free ends of the webs together where the panels 38 would otherwise be abutting one another. Although the webs of flexible material could not be provided with rigid downturned edges, as on the panels 38, the tight clamping action provided by the cooperating channels 66,68, plate 89, and gasket strips 90 should be adequate to provide a secure, watertight seal at that location.

It should thus be apparent that the contaminant shield system of the present invention provides a way of guarding against catastrophic damage to expensive, sophisticated equipment and consequent loss of business. It can be used in a wide variety of areas and installed in existing structures without modifying the existing finished ceiling, utilities above, or overhead flooring or slabs. Since it utilizes a number of components that are readily available from current commercial sources, the costs involved can be kept at a lower level than would otherwise be the case. Moreover, personnel can be readily trained to become skilled in installation techniques, thus saving time and expense.

Furthermore, the modular nature of the shield provides relatively quick and convenient access to the area above the shield if and when the need arises. By using common fasteners such as bolts and screws to hold components of the shield into a rigid structure, the supports 48 and panels 38 can be disassembled quickly and easily to the extent necessary to provide access from beneath the shield to the utilities region 14. Obviously, only a few of the panels 38 and supports 48 may need to be disassembled to provide the required access. If desired, a man-sized opening could be cut into one or more of the panels 38 and a commercially available access hatch could be installed in such opening to facilitate repeated entry into the utilities region 14 from below the shield 10.

Although the foregoing description contains a preferred embodiment of the invention, including many details and specifications, these should not be construed as limiting the scope of the present invention, but as rather providing examples of ways to carry out the invention. Those skilled in the art could obviously make various modifications to the illustrated disclosure without departing from the spirit of the invention. Accordingly, the scope of the present invention should be determined by the appended claims and their legal equivalents, rather than by the specific examples given.

I claim:

1. In a building construction, the improvement comprising:

means defining a generally horizontally extending overhead boundary;

means defining a ceiling spaced below the boundary to present a utilities region above the ceiling and a use area below the ceiling;

a safety shield impervious to liquid penetration and located within said region between the ceiling and the overhead boundary for protecting the use area from intrusive liquids which enter the region above the shield.

said shield including a plurality of interconnected panels secured within generally the same plane to present an imperforate, generally flat surface overlying the ceiling, said shield further including a plurality of parallel, spaced rows of elongated supports for said panels, said supports of each row having a pair of opposite ends and being arranged in end-to-end relationship with one another, the panels being disposed between proximal pairs of the rows of supports and secured thereto, each of said supports including a pair of opposed, elongated clamping members, said panels having marginal edge portions sealingly clamped between said members.

2. In a building construction as claimed in claim 1, one member of each support having a pair of spaced, upstanding, edges which extend parallel to the longitudinal axis of the one member, marginal edge portions of adjacent panels having respective downturned lips hooked over corresponding upstanding edges of the one member.

3. In a building construction as claimed in claim 2, the other clamping member of each support comprising a plate that extends parallel to the longitudinal axis of the one member and is sufficiently wide as to span said edges of the one member and said lips of the panels hooked over said edges.

4. In a building construction as claimed in claim 3, there being sealing gasket means disposed between said plate and said marginal edge portions of the panels.

5. In a building construction as claimed in claim 4, said one member and said plate being provided with means releasably and forcibly holding the one member and the plate clamped against marginal edge portions of the panels.

6. In a building construction as claimed in claim 4, said plate having a stiffening channel coupled therewith and extending parallel to the longitudinal axis of the one member to structurally reinforce the plate.

7. In a building construction as claimed in claim 1, said clamping members of each support including a lower, transversely U-shaped, elongated channel having a pair of laterally spaced apart, upwardly projecting edges and an upper, elongated plate that extends parallel to the longitudinal axis of the channel and is sufficiently wide as to span said edges of the channel, said marginal edge portions of panels on opposite sides of each support including downturned lips hooked over the upwardly projecting edges of the channel and disposed beneath said plate.

8. In a building construction as claimed in claim 7, said plate being provided with sealing gasket means between the same and said marginal edge portions of the panels on opposite sides of each support.

9. In a building construction, the improvement comprising:

means defining a generally horizontally extending overhead boundary;

means defining a ceiling spaced below the boundary to present a utilities region above the ceiling and a use area below the ceiling; and a safety shield impervious to liquid penetration and located within said region between the ceiling and the overhead boundary for protecting the use area from intrusive liquids which enter the region above the shield, said shield including a plurality of interconnected panels secured within generally the same plane to present an imperforate, generally flat surface overlying the ceiling, said shield further including a plurality of parallel, spaced rows of elongated supports for said panels, said supports of each row having a pair of opposite ends and being arranged in end-to-end relationship with one another, the panels being disposed between proximal pairs of the rows of supports and secured thereto, said panels being arranged in a series between each pair of rows of supports, each of said supports having upright end plates at its opposite ends adapted to abut corresponding end plates on the next support in the row, each of said panels having a pair of opposite end faces adapted to abut adjacent end faces on neighboring panels in the series, there being sealing gasket means between each pair of abutting end plates and between each pair of abutting end faces.

10. In a building construction as claimed in claim 9, the abutting end plates of adjacent supports in each row having means releasably fastening the end plates in said abutting relationship.

11. In a building construction as claimed in claim 10, the abutting end faces of panels having means releasably retaining the end faces in said abutting relationship.

12. In a building construction as claimed in claim 11, each of said panels being rectangular, having said end faces along the two opposite ends of the panel and having marginal edges along opposite sides of the panel, each of said supports including a pair of opposed clamping members sealingly engaging opposite surfaces of said marginal edge portions of each panel.

13. In a building construction as claimed in claim 12, said clamping members of each support including a lower, transversely U-shaped, elongated channel having a pair of laterally spaced apart, upwardly projecting edges and an upper, elongated plate overlying said edges of the channel and spanning the same, said marginal edge portions of panels on opposite sides of each support including downturned lips hooked over the upwardly projecting edges of the channel and disposed beneath said plate, said upright end plates at opposite ends of each support being fixed to and projecting upwardly from said clamping plate of the support.

14. In a building construction as claimed in claim 13, said clamping plate being provided with sealing gasket means between the same and said marginal edge portions of the panels on opposite sides of each support.

* * * * *